US008147013B2

(12) United States Patent
Park

(10) Patent No.: US 8,147,013 B2
(45) Date of Patent: Apr. 3, 2012

(54) REFRIGERATOR AND RAIL ASSEMBLY THEREOF

(75) Inventor: Hyung-Kyu Park, Changwon (KR)

(73) Assignee: LG Electronics Inc., Seoul (KR)

( * ) Notice: Subject to any disclaimer, the term of this patent is extended or adjusted under 35 U.S.C. 154(b) by 319 days.

(21) Appl. No.: 12/442,684

(22) PCT Filed: Oct. 23, 2007

(86) PCT No.: PCT/KR2007/005216

§ 371 (c)(1),
(2), (4) Date: Apr. 20, 2009

(87) PCT Pub. No.: WO2008/051003

PCT Pub. Date: May 2, 2008

(65) Prior Publication Data

US 2009/0322196 A1 Dec. 31, 2009

(30) Foreign Application Priority Data

Oct. 25, 2006 (KR) ..... 10-2006-0104115

(51) Int. Cl.
*A47B 88/04* (2006.01)

(52) U.S. Cl. ..... 312/402; 312/404; 312/331

(58) Field of Classification Search ..... 312/402, 312/404, 480, 410, 331, 334.7, 334.8, 116, 312/311, 350; 62/377, 382, 440
See application file for complete search history.

(56) References Cited

U.S. PATENT DOCUMENTS

| | | | | |
|---|---|---|---|---|
| 1,806,174 | A * | 5/1931 | Morin | 312/331 |
| 5,335,987 | A * | 8/1994 | Hodge et al. | 312/323 |
| 7,594,707 | B2 * | 9/2009 | Kunkle et al. | 312/402 |
| 7,740,331 | B2 * | 6/2010 | Koo | 312/404 |
| 2003/0173882 | A1 * | 9/2003 | Koons | 312/404 |
| 2005/0160854 | A1 * | 7/2005 | Rotter | 74/422 |
| 2006/0250059 | A1 * | 11/2006 | Lemm | 312/331 |
| 2008/0314067 | A1 * | 12/2008 | Lee | 62/441 |
| 2009/0261698 | A1 * | 10/2009 | Cabal Velarde et al. | 312/334.8 |

FOREIGN PATENT DOCUMENTS

| | | | |
|---|---|---|---|
| EP | 512615 | * | 11/1992 |
| EP | 1036526 | * | 9/2000 |
| JP | 6-257935 | A | 9/1994 |
| KR | 1998-082301 | A | 12/1998 |
| KR | 10-0634361 | B1 | 10/2006 |
| WO | WO-2007/007950 | A1 | 1/2007 |

* cited by examiner

*Primary Examiner* — James O Hansen
*Assistant Examiner* — Matthew Ing
(74) *Attorney, Agent, or Firm* — Birch, Stewart, Kolasch & Birch, LLP

(57) ABSTRACT

In a rail assembly structure according to an embodiment of the present invention, a shaking prevention member preventing the shaking of a storage container is provided at a position lower than a rail member so that the upper volume and the lower volume of the storage container received in the storage space of the refrigerator is increased as compared to the conventional refrigerator.

12 Claims, 2 Drawing Sheets

[Fig. 1]
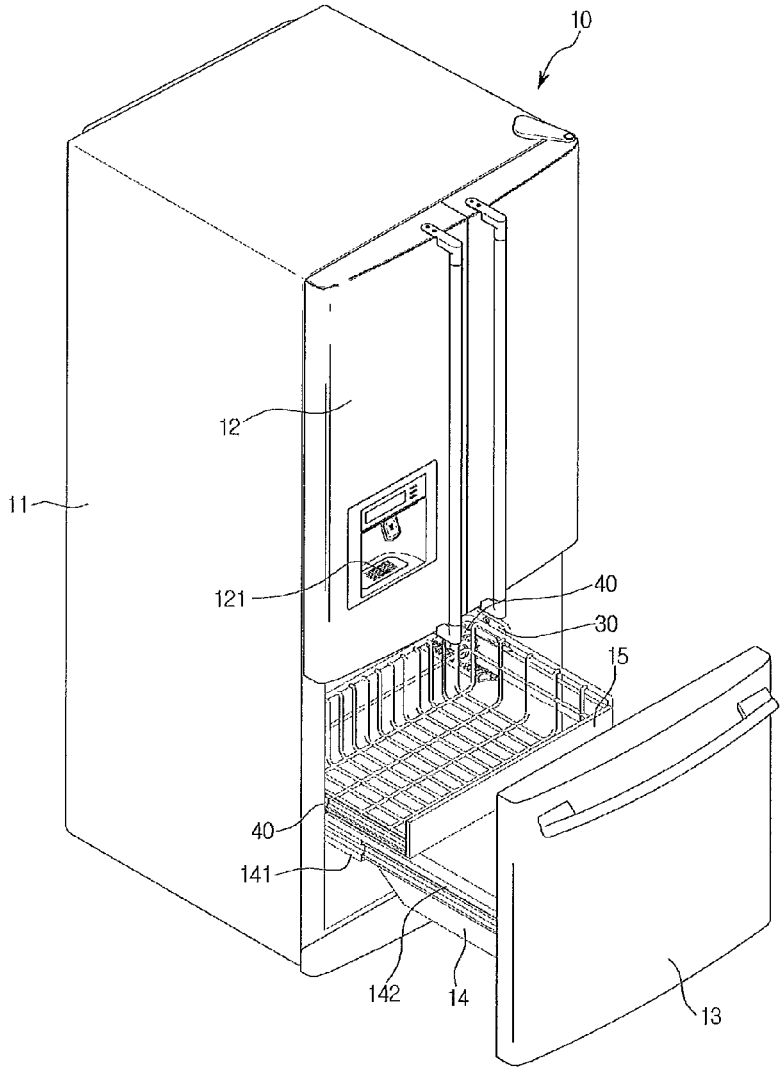
[Fig. 2]
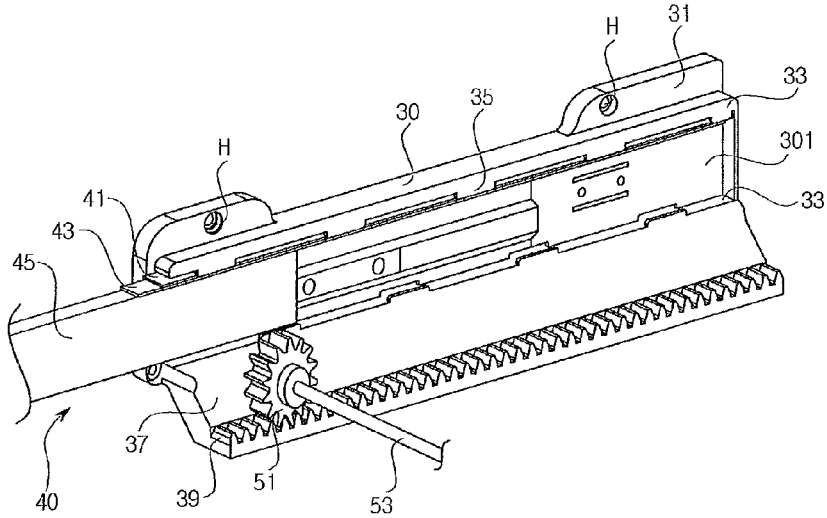

[Fig. 3]
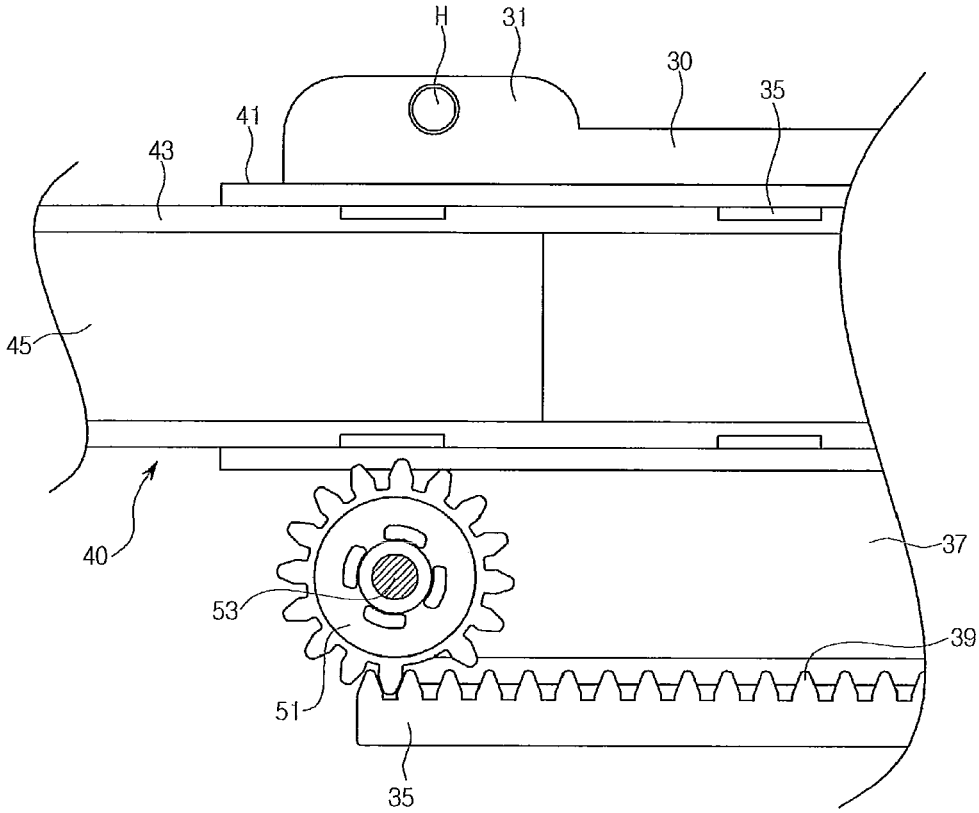
[Fig. 4]
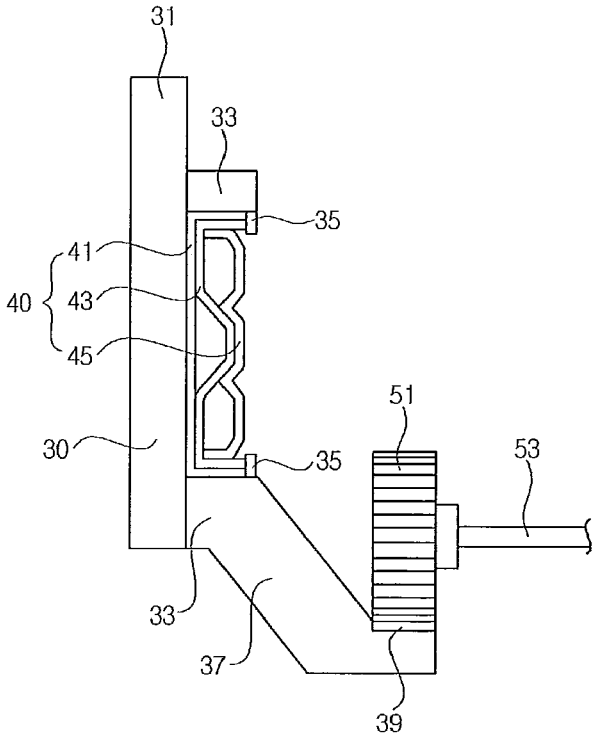

REFRIGERATOR AND RAIL ASSEMBLY THEREOF

TECHNICAL FIELD

This document relates to a rail assembly of a refrigerator.

BACKGROUND ART

Generally, a refrigerator is partitioned into a cooling chamber for freshly storing foods and a cold chamber for storing foods in a freezing state. And, a side by side type, a top mount type and a bottom freezer type is divided according to a position of the cooling chamber and the cold chamber.

Recently, the demand for the bottom freezer type refrigerator wherein the cold chamber is provided at a lower side and the cooling chamber is provided at the upper side has been significantly grown.

The bottom freezer type refrigerator is formed of a structure that can be drawn in and out forward and backward since the door of the cooling chamber is provided in a two door type and the cooling chamber is provided in a drawer type. And, the cold chamber may be provided with a cold chamber drawer capable of receiving frozen foods and a separate storage box at the upper side of the cold chamber drawer. Both the storage box and the drawer are provided to be able to be drawn in and out frontward and backward by the rail.

Meanwhile, a rear end of the cold chamber drawer or the storage box is provided with a shaking prevention structure to prevent a left and right shaking phenomenon in the drawing in and out processes of the cold chamber drawer or the storage box.

In detail, the shaking prevention structure is constituted by a shaft having a length corresponding to a width of the cold chamber drawer or the storage box and a rack coupled to both ends of the shaft. And, a rail member guiding the drawing in and out of the cold chamber drawer or the storage box is provided to walls of both sides of the cold chamber. And, a pinion is horizontally formed from the side of the rail member toward the central of the cold chamber. And, the pinion is extended from the front to the rear of the cold chamber. And, the rack is firmly seated to the pinion to prevent the left and right shaking phenomenon in the drawing in and out processes of the cold chamber drawer or the storage box.

DISCLOSURE OF INVENTION

Technical Problem

However, in the case of the conventional refrigerator as above, it has a disadvantage that the capacity of the storage box or the cold chamber drawer is limited due to the shaking prevention structure.

In particular, since the storage box provided at the upper side of the cold chamber drawer is provided in the state where its upper and lower widths are small, a need is raised to increase the capacity of the storage box through an improvement of the shaking prevention structure.

Technical Solution

In order to accomplish an object of the present invention, a rail assembly of a refrigerator comprises: a rail housing mounted to both sides between foods storage spaces; a rail member coupled to the rail housing to guide the drawing in and out of a storage container; a shaking prevention member coupled to the rear end of the storage container to prevent the left and right shaking of the storage container; and a rack member positioned at the lower side of the rail housing and movably contacted to the shaking prevention member.

Also, in order to accomplish an object of the present invention, a refrigerator comprises: a main body having a storage space for storing foods;

a storage container provided to be able to be drawn in and out to the storage space; rail housings coupled to both sides of the storage space; rail members coupled to both sides of the storage container and respectively received in the rail housings to guide the frontward and backward drawing in and out of the storage container; a shaking prevention member including a shaft horizontally coupled to a rear end of the storage container and pinions rotatably coupled to both ends of the shaft; and rack members enabling the pinions to be seated thereon and to move at lower sides of the rail housings.

ADVANTAGEOUS EFFECTS

With the rail structure according to an embodiment of the present invention, the upper and lower widths of the storage box or the cold chamber drawer received in the cold chamber are increased so that the storage space of foods is increased.

BRIEF DESCRIPTION OF THE DRAWINGS

FIG. 1 is a perspective view showing a portion of a refrigerator provided with a rail assembly according to an embodiment of the present invention;

FIG. 2 is a perspective view showing a rail assembly according to an embodiment of the present invention;

FIG. 3 is a partial side view of the rail assembly; and

FIG. 4 is a front view of the rail assembly.

MODE FOR THE INVENTION

FIG. 1 shows a perspective view of a portion of a refrigerator provided with a rail assembly according to an embodiment of the present invention.

Referring to FIG. 1, a refrigerator 10 according to an embodiment of the present invention is a main body 11 having a cool chamber and a cold chamber therein; a cooling chamber door 12 rotatably provided to the front of the main body 11; and a cold chamber door 13 slidingly drawn in and out forward and backward from the main body 11.

The main body 11 has a structure wherein the cooling chamber is provided at the upper side and the cold chamber is provided at the lower side. However, the idea of the present invention is not limited to the proposed structure.

In detail, the rear of the cold chamber door 3 is mounted with a drawer 14 for storing foods that should be stored in a frozen state and the drawer 14 is detachably coupled to a frame 142 extended from both side end of the rear of the cold chamber door 13.

Also, the outside of the frame 142 is mounted with a drawer rail 141 to allow the drawer 14 to be drawn in and out forward and backward. And, the drawer rail 141 is coupled to both sides of the inside of the cold chamber Also, the upper side of the drawer 14 may be further provided with a separate storage box. In the present embodiment, a wire basket 14 as shown will be described as an example.

In detail, both sides of the wire basket 15 is provided with a basket rail 40 to allow the wire basket 150 to be drawn in and out forward and backward. And, the rear end of the wire basket 15 is coupled with a shaking prevention member 50.

And, the basket rail 40 is coupled to the rail housing 30 fixed to both sides of the cold chamber to be able to be drawn in and out The idea of the present invention improves the structure of the basket rail 40 supporting the wire basket 15 to increase the upper and lower widths of the storage box such as the wire basket 15. Hereinafter, the idea of the present invention as above will be described in more detail with reference to the accompanying drawings.

FIG. 2 shows a perspective view of a rail assembly according to an embodiment of the present invention, FIG. 3 shows a partial side view of the rail assembly, and FIG. 4 shows a front view of the rail assembly.

Referring to FIGS. 2 to 4, the rail assembly according to an embodiment of the present invention comprises the basket rail 40 guiding the movement of the wire basket 15 and the rail housing 30 provided to the side of the cold chamber to support the basket rail 40.

In detail, the rail housing 30 is formed to be lengthened forward and backward to both sides of the storage space of which the heights correspond to each other, such as the cold chamber and the cooling chamber. And, one surface of the rail housing 30 is provided with a rail seating surface 301 to which the basket rail 40 is firmly seated. The rail seating surface 301 is provided in a shape where it is depressed in the rail housing 30 at a predetermined depth, wherein the basket rail is received in the depressed portion. Therefore, the basket rail 40 and the rail housing 30 form approximately the same surface.

In more detail, the upper end of the rail housing 30 is provided with a engaging piece 31 and the engaging piece 31 is provided a engaging hole H penetrating through the inside and outside thereof. A screw is inserted to be penetrated in the engaging hole H so that the rail housing 30 is fixed to the side of the storage space.

And, the upper and lower ends of the rail seating surface 301 are provided with a rail supporting end 33. The rail supporting end 33, which is a portion of the rail housing 30, is a portion generated due to the rail seating surface depressed at a predetermined depth. Therefore, the rail supporting end 33 play a role of supporting the upper and lower end of the basket rail 40 firmly seated to the rail seating surface 301.

Also, the rail supporting ends 33 are formed with a plurality of a separation preventing piece 35 projected thereon at a predetermined distance. In detail, the plurality of separation preventing piece 35 is projected in a direction opposite to each other from the upper and lower rail supporting ends 33 of the rail housing 30 so that it prevents the basket rail 40 from separating from the rail housing 30.

Also, the front end of the rail supporting end 33 provided in the lower end of the rail housing 30 is provided with a rack connector 37 extended approximately downward. The rack connector 37 may be extended perpendicularly downward from rail supporting end 33 or slantly extended downward at a predetermined angle.

The end of the rack connector 37 is further provided with a rack 39. And, the rack is extended by length corresponding to the length of the rail housing 30. And, the rack 39 is firmly seated with the shaking prevention member for preventing the left and right shaking of the basket.

In detail, the shaking prevention member 50 is constituted by a shaft 53 having a length corresponding to the width of the wire basket 15 and a pinion 51 rotatably coupled to both ends of the shaft 53. And, the pinion 51 is firmly seated to the rack 39 so that they are geared with each other. Therefore, in the drawing in and out process of the wire basket 15, the pinion 51 rotates along the rack 39 and at the same time, moves forward and backward.

Meanwhile, the basket rail 40 firmly seated to the rail seating surface 301 comprises a fixing rail 41 fixed to the rail housing 30, a guide rail 43 extendably coupled from the fixing rail 41, and a moving rail 45 extendably coupled from the guide rail 43. And, the basket rail 40 is provided to both sides of the storage space, respectively. And, the basket rail 40 is extendably coupled to the plurality rail members so that the wire basket 15 can be drawn out outside the storage space.

Referring to FIG. 4, the cross section of the fixing rail 41 is formed in "□" shape and the opened portion thereof is installed toward the central of the storage space. In other words, the perpendicular portion of the fixing rail 41 is closely attached to the rail seating surface 301.

Also, the inner side of the fixing rail 41 is provided with the guide rail. The cross section of the guide rail 43 is formed in □shape due to the rail housing 30 opened in a direction opposite to each other, And, the guide rail 43 is drawn in and out forward and backward along the fixing rail 41.

Also, the inner side of the guide rail 43 is provided with the moving rail 45. The moving rail 45 is guided and drawn out by the guide rail 43. Therefore, the basket rail 40 can be drawn out in a multi-stage by means of the plurality of rail members.

The rack 39 of the rail housing 30 is geared with the pinion. The pinion 51 is connected to the shaft 53 and the shaft 53 is connected to the rear end of the wire basket 15 in a horizontal direction.

Hereinafter, an action of a rail assembly for a basket accepting and drawing according to the present invention having a constitution as above will be described.

First, a coupling process of the rail assembly for the basket accepting and drawing according to the present invention will be described in detail.

A screw is inserted in the engaging hole H formed in the engaging piece 31 to fix the rail housing 30 to the side of the storage space. And, the basket rail 40 is engaged with the rail seating surface 301 of the rail housing 30. First, the fixing rail 41 provided in the basket rail 40 is firmly seated to the rail seating surface 301.

The fixing rail 41 is coupled to the guide rail 43. And, the guide rail 43 is coupled to the moving rail 45. The separation of the basket rail 40 is prevented by the separation preventing piece 35 projected on the upper and lower ends of the rail seating surface 301.

When the basket rail 40 is coupled to the rail housing 30, one surface of the moving rail 45 is coupled to one surface of the wire basket 15. And, the rear end of the wire basket 15 is coupled to the shaking prevention member 50 constituted by the pinion 51 and the shaft 53.

Hereinafter, an operation process of the rail assembly for the basket according to the present invention will be described in detail.

The wire basket 15 is drawn out in an opened direction of the storage space 11. Then, the shaft 53 connected to the wire basket 15 moves in the movement direction of the basket 15. And, the pinion 51 provided in both ends of the shaft 53 is rotated and moved along the rack 39.

When the wire basket 15 is drawn out in the opened direction of the storage space 11, the moving rail 45 connected to the side of the basket moves in the opened direction of the storage space by means of the movement of the basket. At this time, the moving rail 45 is guided and moved by means of the guide rail 43 and the guide rail 43 is supported by means of the fixing rail 41. And, the wire basket 15 prevents the left and light shaking phenomenon by means of the shaking prevention member 50 in the drawing out or in process.

The invention claimed is:

1. A rail assembly of a refrigerator, comprising:

a rail housing mounted to a side surface of a food storage space and provided with a rail seating surface and a rail supporting end defining a lower part of the rail seating surface;

a rail member received in the rail seating surface to guide a storage container to be drawn in and out, the rail member supported by the rail supporting end;

a shaking prevention member coupled to a rear end of the storage container to prevent the storage container from shaking in a left and right direction;

a rack member being spaced from a lower end of the rail housing, the rack member comprising an upper surface, a lower surface, and gear teeth extending upwardly from said upper surface, and said gear teeth inter-engaged with the shaking prevention member, wherein the shaking prevention member is movably contacted to the rack member, and a rack connector extending downwards from the lower end of the rail housing and being connected to the upper surface of rack member, at least one portion of the rack connector being disposed at an upper side of the gear teeth, wherein the shaking prevention member comprises:

a rotatable pinion; and a shaft coupled to a central part of the pinion and being lower than the rail supporting end, and higher than the upper surface of the rack member.

2. The rail assembly as claimed in claim 1, wherein the rack connector is extended downwards at an angle from the lower end of the rail housing.

3. The rail assembly as claimed in claim 1, wherein the rail housing is formed with the rail seating surface depressed at a predetermined depth so that the rail member is firmly seated.

4. The rail assembly as claimed in claim 1, further comprising separation preventing pieces projected from an upper end and the lower end of the rail housing, respectively, to prevent the separation of the rail member.

5. The rail assembly as claimed in claim 4, wherein the separation preventing pieces are formed to be spaced from one another at a predetermined distance.

6. The rail assembly as claimed in claim 1, wherein the rail member is a structure that can be drawn out in a multi-stage.

7. The rail assembly as claimed in claim 1, wherein the rack connector extends downwardly and inwardly from the rail housing.

8. A refrigerator, comprising:

a main body having a storage space for storing foods;

a storage container provided to be able to be drawn in and out to the storage space;

rail housings coupled to both sides of the storage space, the rail housing provided with a plurality of rail supporting ends;

rail members coupled to both sides of the storage container and respectively received in the rail housings to guide the frontward and backward drawing in and out of the storage container, the rail members disposed between the plurality of rail supporting ends;

a shaking prevention member coupled to a rear end of the storage container to prevent the storage container from shaking in a left and right direction; rack members enabling the pinions to be seated thereon and to move at lower sides of the rail housings, each said rack member being spaced from the lower ends of the rail housings; each said rack member comprising an upper surface, a lower surface, gear teeth extending upwardly from said upper surface, said gear teeth inter-engaged with the shaking prevention member; rack connectors, each rack connector extending downward from a lower end of one of the rail housings and being connected to the upper surface of one of the rack members;

wherein the shaking prevention member comprises:

a shaft horizontally coupled to a rear end of the storage container, an extension line of the shaft configured to cross the rack connector; and pinions rotatably coupled to both ends of the shaft, the shaft disposed lower than a lower side of the plurality of rail supporting ends; and higher than upper surface of the rack members.

9. The refrigerator as claimed in claim 8, wherein the storage container comprises at least one of a cold chamber drawer and a storage box provided on an upper side of the cold chamber drawer.

10. The refrigerator as claimed in claim 8, wherein the rack connectors are extended downward at a predetermined angle.

11. The refrigerator as claimed in claim 8, wherein each of the rail members comprises:

a fixing rail fixed to the side of the storage space;

a guide rail extendably coupled to the fixing rail; and a moving rail extendably coupled from the guide rail.

12. The refrigerator as claimed in claim 8, wherein each of the rack connectors extends inwardly from the rail housing.

* * * * *